US007168652B2

(12) United States Patent
Tokunaga

(10) Patent No.: US 7,168,652 B2
(45) Date of Patent: Jan. 30, 2007

(54) ROLLED PAPER CONVEYING APPARATUS

(75) Inventor: Atsuo Tokunaga, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/690,572

(22) Filed: Oct. 23, 2003

(65) Prior Publication Data

US 2004/0155141 A1 Aug. 12, 2004

(30) Foreign Application Priority Data

Oct. 23, 2002 (JP) ..... 2002-307749

(51) Int. Cl.
*B65H 26/00* (2006.01)

(52) U.S. Cl. ..... 242/563; 242/595; 242/561; 242/357

(58) Field of Classification Search ..... 242/563, 242/695, 595.1, 564.3, 561, 357
See application file for complete search history.

(56) References Cited

U.S. PATENT DOCUMENTS

| | | | | |
|---|---|---|---|---|
| 5,036,359 | A * | 7/1991 | Duijve et al. | 399/389 |
| 5,673,187 | A | 9/1997 | Tokunaga et al. | |
| 5,881,339 | A | 3/1999 | Yanagida et al. | |
| 5,906,333 | A * | 5/1999 | Fortuna et al. | 242/554.5 |
| 5,950,951 | A * | 9/1999 | Brunner et al. | 242/348.1 |
| 5,970,282 | A | 10/1999 | Yanagida et al. | |
| 6,072,703 | A | 6/2000 | Tokunaga | |
| 2002/0148924 | A1 * | 10/2002 | Nobuta et al. | 242/554.1 |

FOREIGN PATENT DOCUMENTS

| | | |
|---|---|---|
| JP | 64-38119 | 3/1989 |
| JP | 1-38119 | 11/1989 |
| JP | 5-16499 | 1/1993 |
| JP | 05337544 A * | 12/1993 |
| JP | 2000-109256 | 4/2000 |
| JP | 2000-136058 | 5/2000 |

* cited by examiner

*Primary Examiner*—William A. Rivera
*Assistant Examiner*—Sang Kim
(74) *Attorney, Agent, or Firm*—Oblon, Spivak, McClelland, Maier & Neustadt, P.C.

(57) ABSTRACT

A rolled paper conveying apparatus for conveying paper of a first rolled paper provided on a core. The apparatus includes a holding device configured to rotatably support the first rolled paper. The holding device is configured to enable movement of the first rolled paper from a first position on the holding device to a second position on the holding device. The apparatus further includes a first detector configured to detect whether the first rolled paper has moved from the first position to the second position. The holding device preferably includes a depressed portion configured to store the first rolled paper.

12 Claims, 9 Drawing Sheets

ROLLED PAPER CONVEYING APPARATUS

CROSS REFERENCE TO RELATED APPLICATIONS

This application claims priority to Japanese Patent Publication 2002-307749 filed on Oct. 23, 2002, the entire contents of which are incorporated by reference.

BACKGROUND OF THE INVENTION

1. Field of the Invention

The present invention relates to a rolled paper conveying apparatus, such as an image forming apparatus, a printer, a facsimile device, a cash register, or a ticket vending machine.

2. Description of the Related Art

Various machines, such as duplicating machines, printers, facsimile machines, registers, and ticket vending machines, use rolls of paper for generating a printed output. Rolled paper includes a plane body, such as light-sensitive paper, heat-sensitive paper, standard paper, or a film, which is wound around a core. Various methods are used to detect the end of rolled paper being used.

Rolled paper is generally defined as paper that is wound around a core. Furthermore, it is classified based upon whether end of the rolled paper is adhered to the core or is not adhered to the core. Generally, the end of the rolled paper is adhered to a core to avoid vibration of the end of the paper once the paper is completely unwound from the core. Additionally, the end of the paper is adhered to the core in order to easily wind the paper around the core during manufacturing.

Various methods are used to detect when an end of the paper of a rolled paper is reached. For example, the end of the rolled paper can be marked. Additionally, a method can be used that detects when the outer diameter of the rolled paper becomes small. (See, e.g., Japanese Patent Laid-Open No. Hei 1-38119.) Another method detects a conveyance speed of paper according to an outer diameter of the rolled paper becoming small with an encoder. (See, e.g., Japanese Patent Laid-Open No. Hei 5-16499.) Another method detects a tension between the core and the conveyance drives, where the tension is produced because of the conveyance drive pulling on the core. (See, e.g., Japanese Patent Laid-Open No. 2000-109256.) Furthermore, there is a method to add a detection device. (See, e.g., Japanese Patent Laid-Open No. 2000-136058.)

However, the above methods have various disadvantages. For example, a method of detecting a tension between a core and the conveyance drives may misinterpret tension that occurs when the machine starts or when rotational speed changes, since a temporarily high state tension can occur at these times. In this case, the problem also exists that the driving gear that is driven by a drive device can be broken by being overly pulled. In order to account for such a consideration, the drive device tends to become complicated, which increases the cost of the device.

Various methods require the use of a specific type of rolled paper, thereby limiting the choices of paper that can be used in a particular machine. Therefore, in addition to a specific kind of paper and a specific size, the user must also use a rolled paper having a specific type of marking that that allows the machine to detect the end of the rolled paper. For example, FIGS. 11(A)–(E) depict many different kinds of rolled paper having various markings. Another problem with such methods, the user may not be able to determine what kind of markings are used on a rolled paper until the paper is unrolled. Because, generally, until the paper is unrolled, the user cannot confirm what kind of markings are used. As a result, the machine cannot detect the markings precisely if the wrong kind of marking is used with a given detector.

SUMMARY OF THE INVENTION

The present invention has been developed in order to solve at the least the above-mentioned problems.

The present invention advantageously provides a rolled paper conveying apparatus that avoids breaking a driving gear to convey rolled paper.

One embodiment of the present invention is a rolled paper conveying apparatus that includes a rolled paper having a core, a holding device enabling movement of the rolled paper from a first position to a second position, and a first detector detecting the state that the rolled paper has moved from the first position to the second position.

Another embodiment of the present invention is a rolled paper conveying apparatus that includes a rolled paper having a core, a holding device enabling movement of the rolled paper from a first position to a second position, a first detector detecting the state that the rolled paper has moved from the first position to the second position, and a depressed portion for storing used cores of the rolled paper.

DETAILD DESCRIPTION OF THE PREFERRED EMBODIMENTS

Figure 1A:
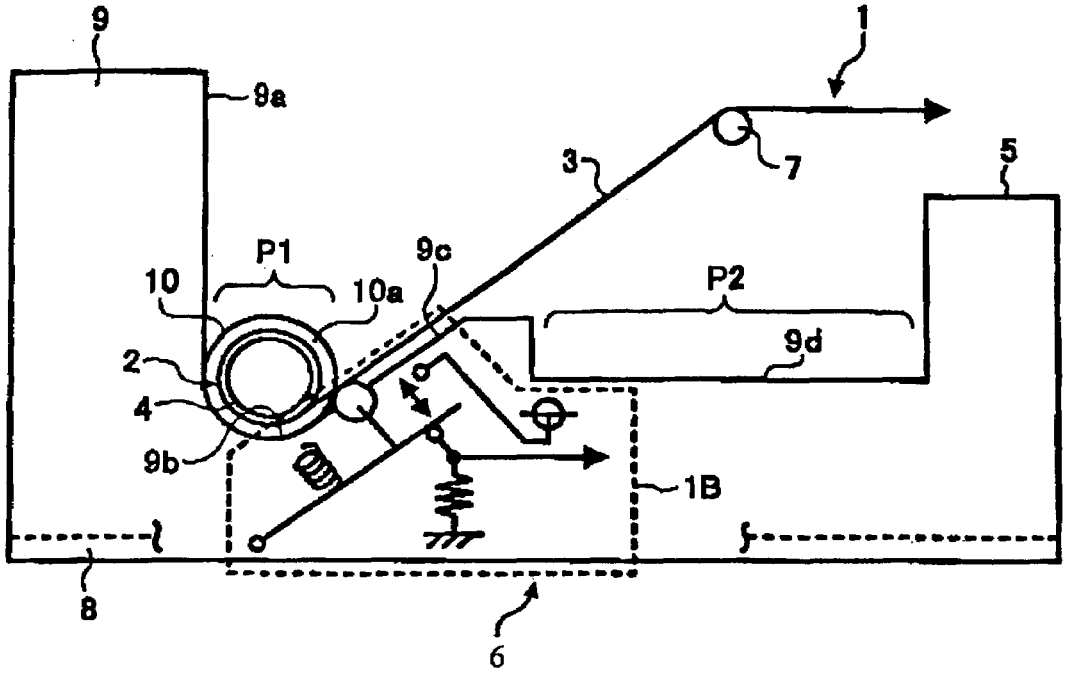
FIG. 1A is a schematic illustration of a conveyer according to a first embodiment of present invention.

As shown in FIG. 1A, the conveyer 1 of this embodiment conveys rolled paper 2 by conveying the paper in the direction of the arrow. As the paper is being unrolled, the rolled paper 2 remains in a first position P1. The conveyer has a maintenance member 5 that allows the rolled paper 2 to move to a second position P2 within a fixed distance when the rolled paper 2 is in a state in which an end of the rolled paper 2 has been reached. A detection apparatus 6 is provided to detect movement of the rolled paper, and a guiding roller 7 is provided to guide the paper 3 drawn from the rolled paper 2 toward the conveyance drive which is not illustrated.

Maintenance member or holding member 5 is configured to have an open top, and is formed of a bottom board 8 and frame boards 9. A distance between the frame boards 9, 9 is longer than that of the rolled paper 2 in the axial direction. In an upper end of the frame boards 9, 9, there are side portions 9*a* that extend in the vertical direction in FIG. 1. The maintenance member 5 includes a maintenance part 9*b* that has a semicircle shape with an open top, a slant part 9*c* that is connected to the maintenance part 9*b*, and a depressed portion 9*d* that is connected to the slant part 9*c* via a bump.

The rolled paper 2 is held in a rotatable manner by the maintenance part 9*b*. When the rolled paper 2 is held by the maintenance part 9*b*, the rolled paper 2 is located in the first position P1. The depressed portion 9*d* is level. When the rolled paper 2 is moved along the slant part 9*c* to the depressed portion 9*d*, the rolled paper 2 is located in the second position P2.

Figure 2B:
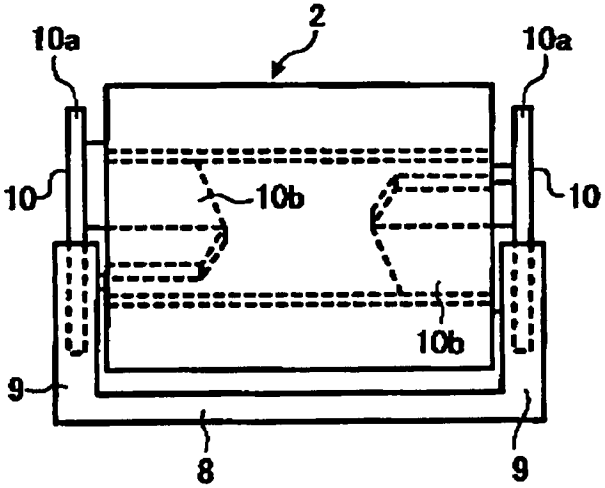
FIG. 2B shows a front view of the attachment member depicted in FIG. 2A.
Figure 2D:
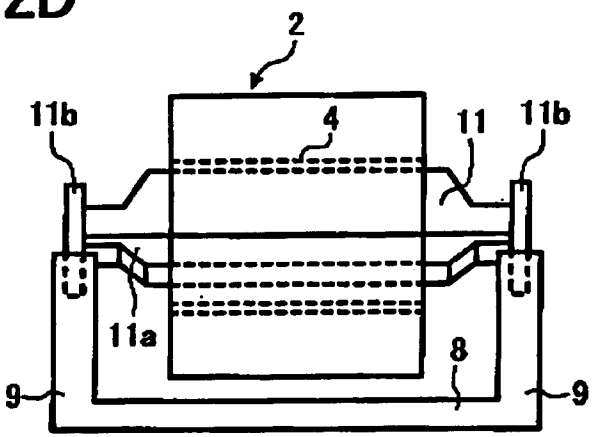
FIG. 2D shows a front view of an attachment member depicted in FIG. 2C.
Figure 2A:
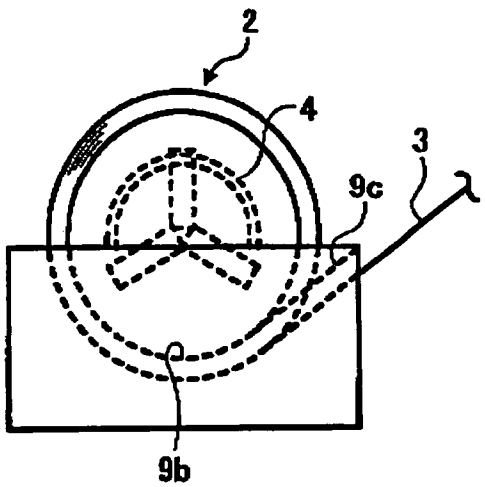
FIG. 2A shows a cross-sectional view of an attachment member of holder type to hold a rolled paper.

As depicted in FIGS. 2A and 2B, the maintenance part 9*b* rotatably holds the rolled paper 2 by a pair of attachment members 10, 10 that have a portion with the same shape as the maintenance part 9*b*. In other words, the attachment member 10 of this holder type has a disc part 10*a* that has a larger outer diameter than that of core 4 of the rolled paper 2, and a plug part 10*b* that has a slightly larger bigger outer diameter than an inside diameter of the core 4 of the rolled paper 2. Therefore, the attachment member 10 rotatably holds the rolled paper 2 by inserting the attachment member 10 in the core 4 of the rolled paper 2 from both sides in an axial direction. In this case, the attachment member 10 can be inserted easily within the core because a length of plug portion 10*b* that extends in the core 4 is short. Once the disc part 10*a* is fitted in the maintenance part 9*b*, the rolled paper 2 can rotate smoothly.

The distance between the bottom board 8 and an edge of maintenance part 9*b* is greater than the largest radius of the rolled paper 2. Therefore, a gap is formed between the outer circumference of the rolled paper 2 and bottom board 8, so that the surface of paper 3 is not damaged through contact between the rolled paper 2 and the bottom board 8.

Figure 2C:
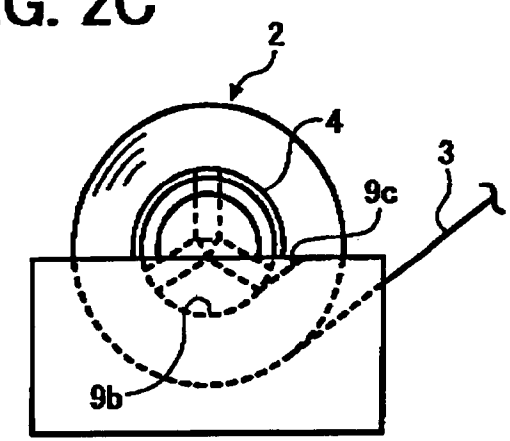
FIG. 2C shows a cross-sectional view of an attachment member of a flange type to hold a rolled paper.

FIGS. 2C and 2D depict alternative configurations of the attachment member. FIGS. 2C and 2D depict an attachment 11 of a flange type that includes a main body part 11*a* formed longer than the axial length of the core 4 and a flange part 11*b* connected to both ends of main body part 11*a*. The main body part 11*a* has an outer circumference that is larger than the inside diameter of the core 4 of the rolled paper 2. The flange part 11*b* has a smaller outer diameter than the inner diameter of the core 4 of the rolled paper 2. Therefore, by inserting the main body part 11*a* in the core 4 of the rolled paper 2, the attachment member 11 holds the rolled paper 2 in a rotatable manner.

Figure 2F:
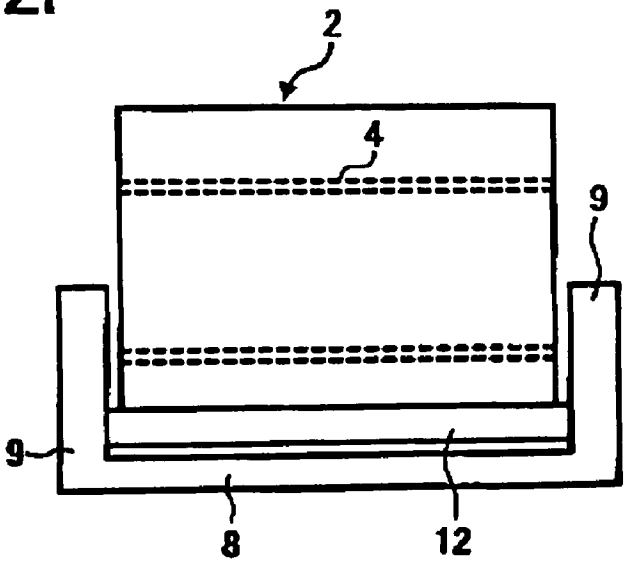
FIG. 2F shows a front view of the attachment member depicted in FIG. 2E.
Figure 2E:
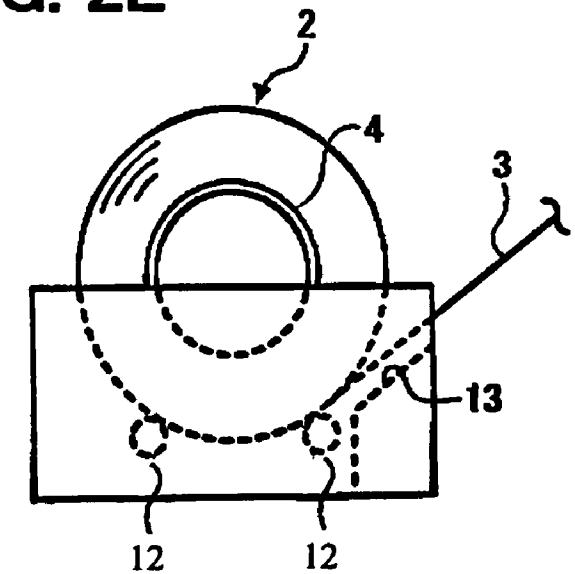
FIG. 2E shows a cross-sectional view of another attachment member to hold a rolled paper.

Alternatively, the rolled paper 2 can be rotatably held in the without inserting an attachment member in the rolled paper 2. For example, FIGS. 2E and 2F provides such an embodiment using maintenance rollers 12. In this configuration, one pair of maintenance rollers 12 is attached to the frame member 9 to keep the bottom of the rolled paper 2 rotatably supported. A slanted face 13 is provided such that the rolled paper 2 can move an appointed distance when the end of the rolled paper 2 is reached.

Therefore, according to the configuration of FIGS. 2E and 2F, the attachment members 10 and 11 are not necessary, thus attaining a reduction of parts and making it is easier to exchange an old or used rolled paper with a new rolled paper. This configuration is also advantageous because various sizes and kinds of rolled paper 2 having various sized cores can be rotatably supported and used with the conveyer 1. Additionally, this configuration is also preferable since it does not include attachment member, which might require a turn assistance member (such as bearing) between a rotational member and fixed members in order to allow the rolled paper 2 to turn smoothly.

As shown in FIG. 1A, a guiding roller 7 is provided at an upward position above the depressed portion 9*d*, which forms the second position P2 in FIG. 1A. The rotational axis of the guiding roller 7 is in parallel with the rotational axis of the rolled paper 2 held by maintenance part 9*b*. Therefore, the paper 3 does not touch the slant part 9*c*.

Figure 1B:
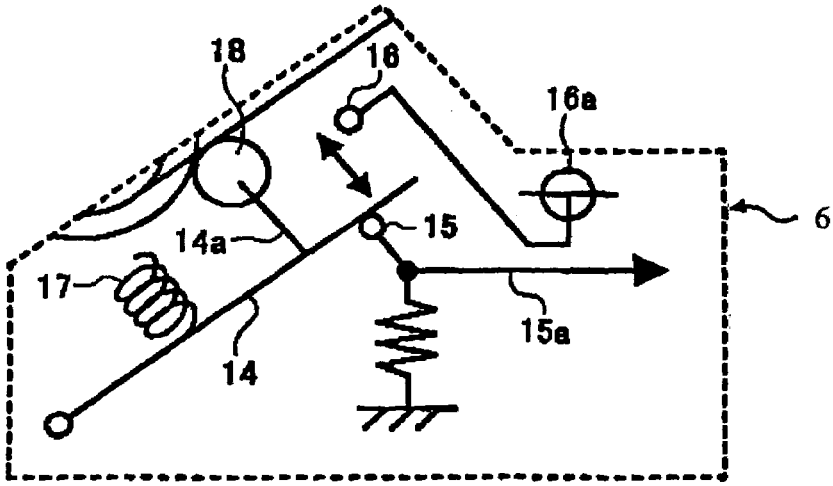
FIG. 1B shows a detection apparatus.

A detection apparatus 6 is positioned below the maintenance part 9*b*. As shown in FIG. 1B, the detection apparatus 6 has two selected point of contact terminals 15, 16 and a swung swing arm 14, which is moved when the rolled paper 2 is transferred out of the first position P1. The swing arm 14 is arranged toward the guiding roller 7 from a lower position of the maintenance part 9*b*, and an end of the swing arm 14 is pivotally supported. Therefore, the swing arm 14 is supported to swing.

A predetermined voltage of 5V is supplied to the swing arm 14. A free edge of coil spring 17 is connected to swing arm 14. The swing arm 14 is biased to swing toward the first position P1 by the coil spring 17. A branch member 14*a* is provided in the middle of the swing arm 14, and a contacting member 18 is provided on the tip of branch member 14*a*. The contacting member 18 can extend from the maintenance member 5 toward the rolled paper 2 in the first position P1 or the disc part 10*a* of the attachment member 10. Therefore, when the rolled paper 2 is in the first position P1, the contacting member 18 is depressed by the rolled paper 2 or the disc part 10*a* to make swing arm 14 pivot downward. Thus, the contact terminal 15 contacts a tip of the swing arm 14, and thus output line 15*a* is connected to contact terminal 15. When the tip of the swing arm 14 contacts the contact terminal 15, a message in the form of a signal of a predetermined voltage is output by output line 15*a*.

When the rolled paper 2 moved out of the first position P1, thereby removing the weight of the rolled paper pressing on the contacting member 18, then the swing arm 14 is moved upward by the coil spring 17. When the rolled paper 2 is transferred out of the first position P1, then the contact terminal 16 is contacted by a tip of the swing arm 14. An indication lamp 16*a* is connected to contact terminal 16. In this orientation, the tip of swing arm 14 is separated from contact with the contact terminal 15 and thus the output of the signal from output line 15*a* is stopped, and the indication lamp 16*a* is lighted to provide a message to the user due to contact between the swing arm 14 and the terminal 16. Therefore, when the rolled paper 2 is moved to the second position P2 from the first position P1, the output signal from the detection apparatus 6 changes.

There is a swing arm between the rolled paper 2 and the contact terminals 15, 16, so that the middle of the swing arm 14 is not pushed by the rolled paper 2 directly. The transfer width of the tip is increased, because the tip of swing arm 14 touches contact terminals 15, 16 by spring. Therefore, as the tip of swing arm 14 touches the contact terminals 15, 16 with enough speed, it can prevent missed detection. Otherwise, because transfer movement of the rolled paper 2 is conveyed via the swing arm 14, the electric point of contact mechanism can be installed at a distance apart from a path of movement of the rolled paper. In other words, the point where the tip of the swing arm 14 contacts the terminals 15, 16 is advantageously disposed inside the maintenance member 5, and thus dust is prevented from collecting at the contact terminals 15, 16.

The following description explains the movement of the conveyer 1.

The member 10 is attached to the rolled paper 2, and the rolled paper 2 is set in the maintenance part 9*b* of the maintenance member 5 in the first position P1. It is possible to keep space to do attaching work easily. It is possible to set the rolled paper 2 at an appointed position to set in the first position P1 automatically. The tip of paper 3 is drawn from the rolled paper 2 and is set to convey by a conveyance drive via guiding roller 7.

When the conveyer 1 conveys paper 3, conveyance of the rolled paper 2 is started such that the tip of paper 3 advances in along the conveyance course. The paper 3 is drawn such that the rolled paper 2 rotates in the first position P1 of maintenance member 5 smoothly.

When the rolled paper 2 is drawn to the end of the roller paper 2 where the paper 3 is attached to the core 4, then the attachment member 10 is pulled by conveyance power via the paper 3. If the conveyance power is greater than the weight of the core 4 and the attachment member 10, then the core 4 and the attachment member 10 are pulled in a conveyance direction from the first position P1 to the second position P2 as shown in FIGS. 3A and 3B.

Figure 3A:
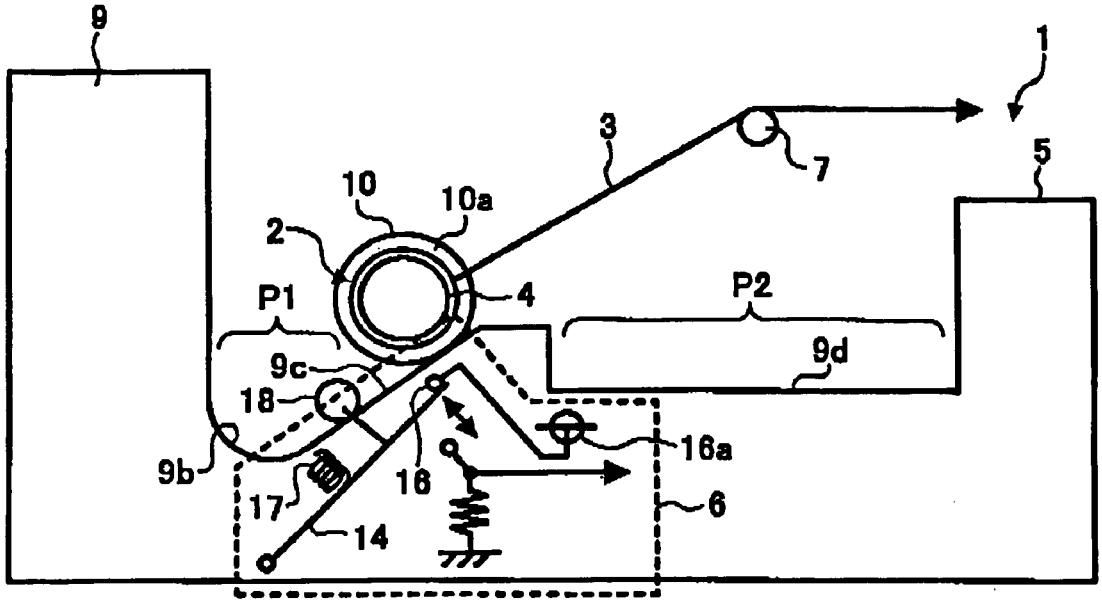
FIG. 3A shows a schematic illustration of an embodiment of a conveyor along which a rolled paper is being transferred according to the present invention.
Figure 3B:
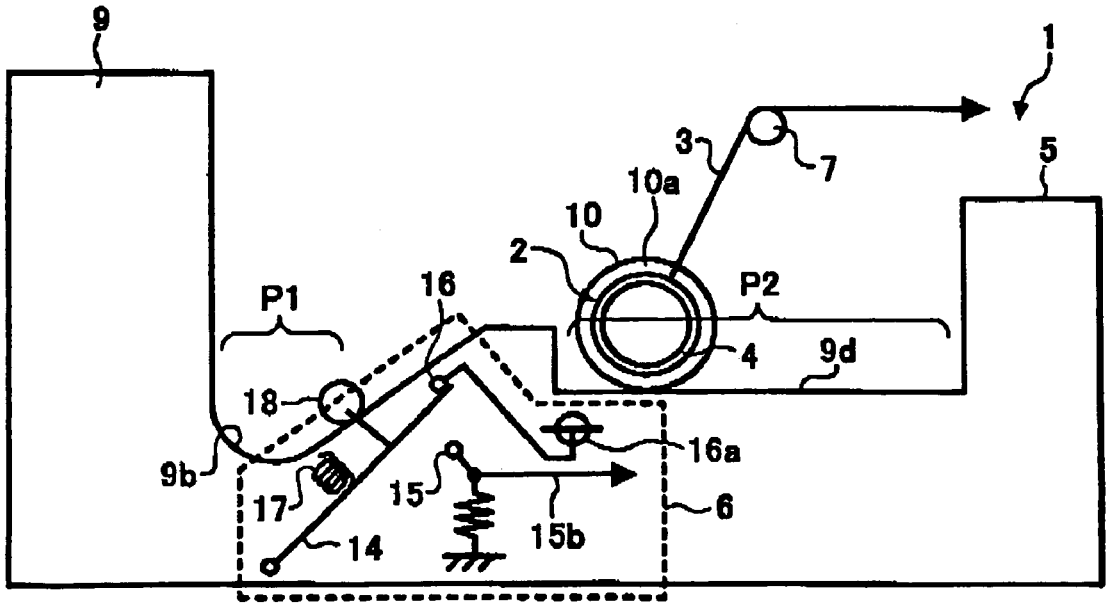
FIG. 3B shows a schematic illustration of the conveyor of FIG. 3A in which the rolled paper is in a stopped state according to the present invention.

When the detection apparatus 6 detects the state that rolled paper 2 moved from the first position P1 to the second position P2, it will stop conveyance movement of a conveyance drive immediately, so that the rolled paper 2 occupies the second position P2 as shown in FIG. 3B. Therefore, it can be stopped without too much load being given to a conveyance drive and transmission mechanism of driving force.

Figure 4:
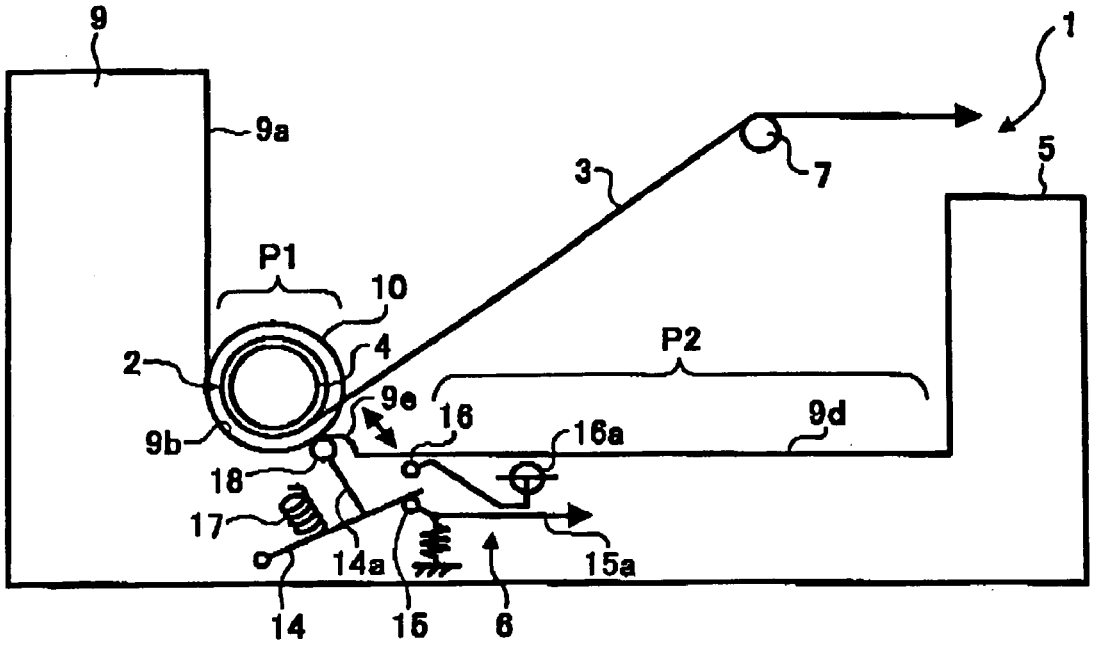
FIG. 4 shows a schematic illustration of another conveyer according to an embodiment of present invention.

FIG. 4 depicts an embodiment similar to the embodiment depicted in FIGS. 3A and 3B. The embodiment in FIG. 4 has a short slant part 9*e*, which requires less load on the conveyance mechanisms in order to move the rolled paper 2 from the first position P1 to the second position P2.

Figure 5:
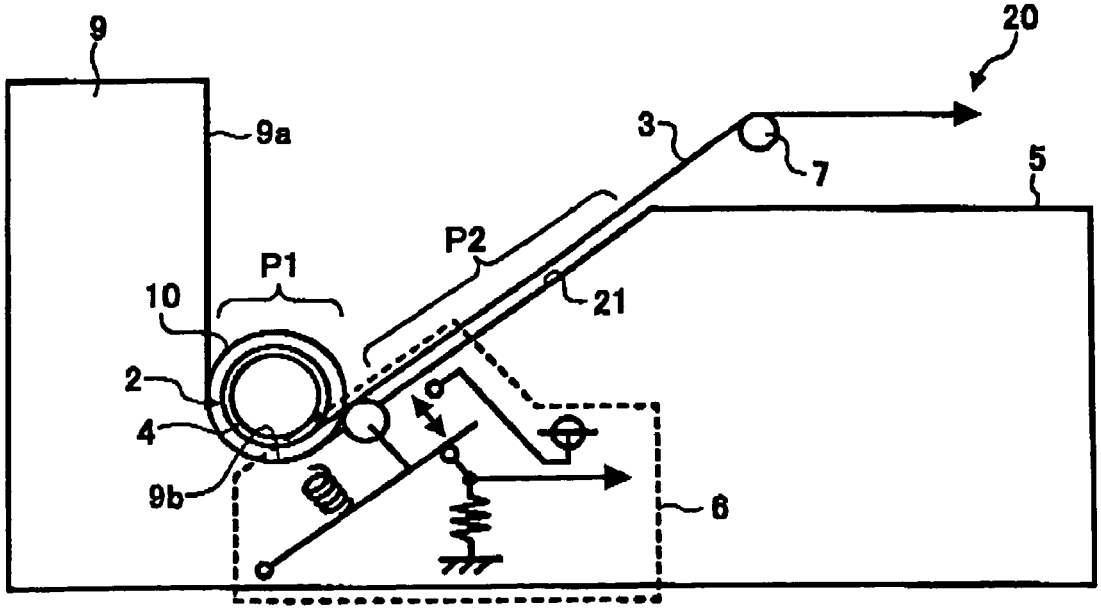
FIG. 5 shows a schematic illustration of a conveyer according to a second embodiment of the present invention.

FIG. 5 depicts a second embodiment of the present invention in which a conveyer 20 can return rolled paper 2 to the first position P1 from the second position P2 by itself. In this embodiment, the maintenance member 5 has the second position P2 adjacent to the first position P1.

In the upper end of the frame member 9 of the maintenance member 5, the slant part 21 is lengthened to an area adjacent to the guiding roller 7 to form the second position P2. The slant part 21 is formed upwardly from the first position P1 to the guiding roller 7 to form a return member for returning the rolled paper 2 from the second position P2 to the first position P1.

When detection apparatus 6 detects the state that the rolled paper 2 moved from the first position P1 to the second position P2, it will stop conveyance movement of a conveyance drive when the rolled paper 2 is midway up the slant part 21. The rolled paper 2 will slide down along the slant face 21 to the first position P1, when the rolled paper 2 is cut manually or automatically, thereby removing restriction of paper 3 on a conveyance course.

Figure 6:
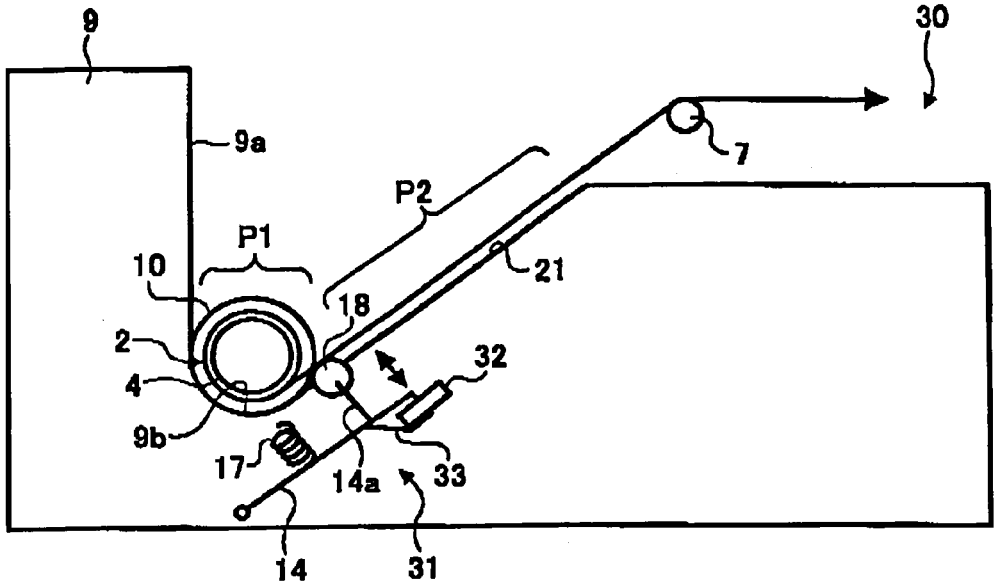
FIG. 6 shows a schematic illustration of a conveyer according to a third embodiment of the present invention.

FIG. 6 depicts a third embodiment of the present invention that includes a conveyer 30. This embodiment includes a detection apparatus 31 that differs from the previously described embodiments. This embodiment includes a detection apparatus that utilizes an optical sensor 32 of a non-contact type, rather than contact terminals.

The detection apparatus 31 has a search piece 33 adhered on the tip of swing arm 14 and an optical sensor 32 installed in place of contact terminal 15 of the second embodiment. A terminal of the optical sensor 32 is connected to output line 15*a*. Therefore, when the swing arm 14 is moved underneath by the rolled paper 2 in the first position P1, the search piece 33 is moved within a detection range of the optical sensor 32. Therefore, a message in the form of a signal is output by the detection apparatus 31, since the optical sensor 32 is turned on by the sensing of the search piece 33. Otherwise, when the swing arm 14 is moved upwardly when the rolled paper 2 is moved out of the first position P1, then the search piece 33 is moved out of range of the optical sensor 32, and the detection apparatus 31 stops outputting a signal because the optical sensor 32 is turned off.

Figure 7A:
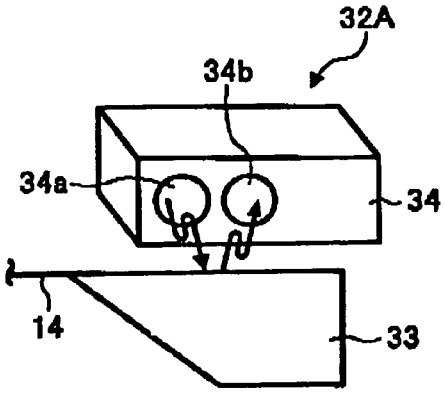
FIG. 7A shows a schematic illustration of an optical sensor in a detecting state.
Figure 7B:
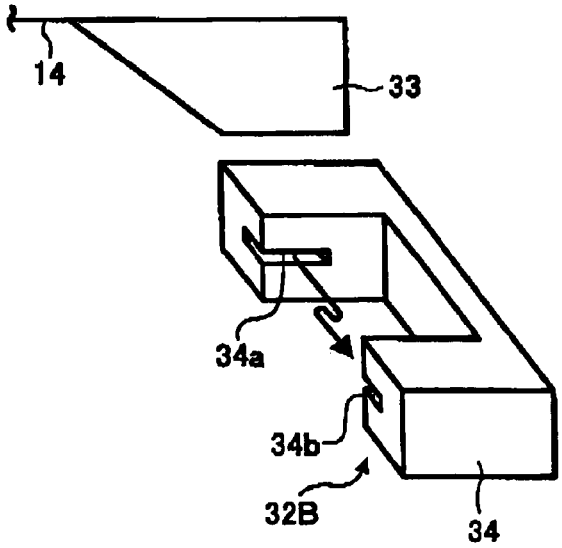
FIG. 7B shows a schematic illustration of an alternative optical sensor in a non-detecting state.

Two embodiments of the optical sensor or photo sensor 32 are depicted in FIGS. 7A and 7B. FIG. 7A depicts an optical sensor 32A of a reflection type that detects reflected light from the search piece 33, and FIG. 7B depicts an optical sensor 32B of a transmission type that detects the transmission of light depending upon the location of the search piece 33.

The optical sensor 32A of the reflection type depicted in FIG. 7A has a light emitting part 34*a* and a light receiving portion 34*b* in housing 34. The search piece 33 is the reflection member that has a reflection side, and a reflection side faces the light emitting part 34*a* and the light receiving portion 34*b*. Therefore, when the search piece 33 faces the light emitting part 34*a* and the light receiving portion 34*b*, light is reflected back by the search piece 33 and the reflected light is input into the light receiving portion 34*b* so that a message in the form of a signal is output from optical sensor 32A. Otherwise, when no reflected light is input into the light receiving portion 34*b*, then a signal is not output form optical sensor 32A.

Figure 8:
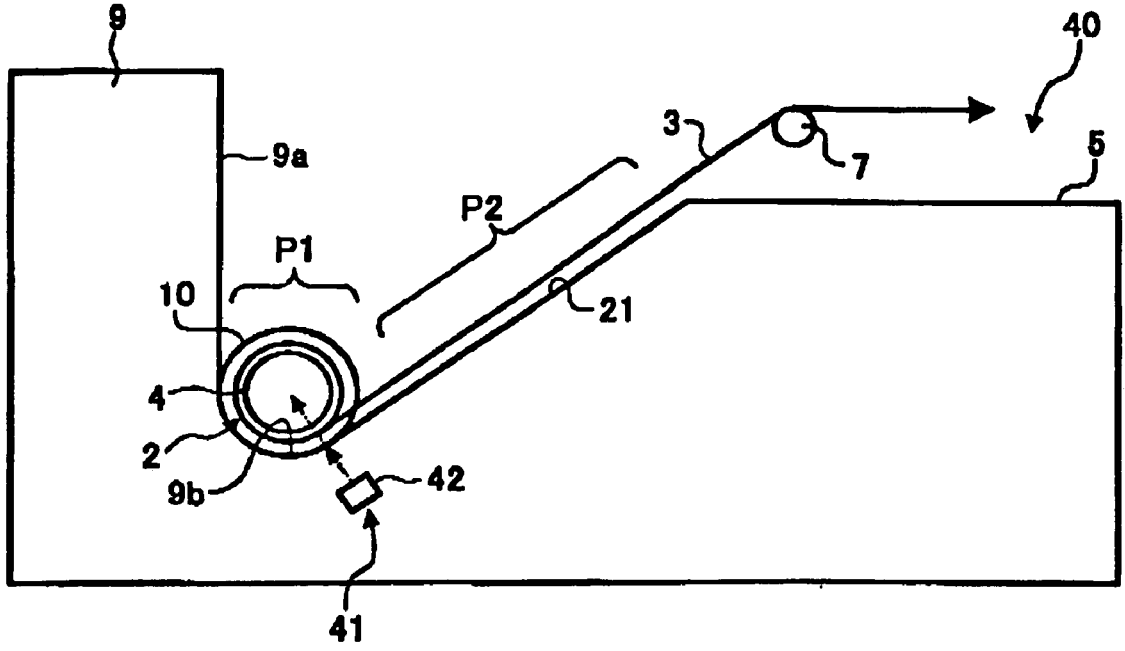
FIG. 8 shows a schematic illustration of a conveyer according to a fourth embodiment of the present invention.

FIG. 8 depicts a fourth embodiment of the present invention that includes a conveyer 40. In this embodiment, an optical sensor 42 is used to detect reflected light that varies according to the movement of the rolled paper 2 as shown in FIG. 8. The optical sensor 42 can detect the end state of the rolled paper 2 without making the rolled paper 2 touch another member. The optical sensor 42 does not detect reflected light when the core 4 of the rolled paper 2 and the attachment member 10 are moved from the first position P1. The optical sensor 42 does detect reflected light when the core 4 of the rolled paper 2 and the attachment member 10 are in the first position P1. Thus, the optical sensor 42 can detect the presence of rolled paper 2 in the first position P1 according to a search state of reflected light of the optical sensor.

Figure 9:
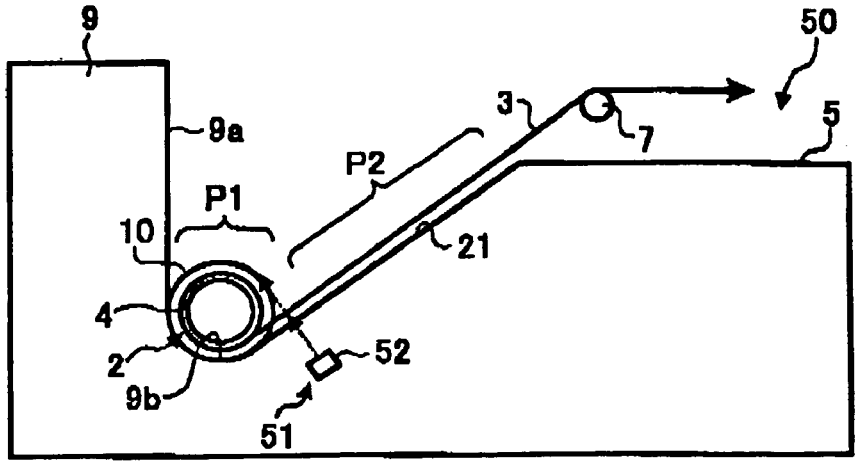
FIG. 9 shows a schematic illustration of a conveyer according to a fifth embodiment of the present invention.

FIG. 9 depicts a fifth embodiment of the present invention. In the fifth embodiment, when the rolled paper 2 reaches an end state and is moved, then movement of the rolled paper 2 having left the first position P1 is detected. The fifth embodiment includes a detection apparatus 51 that has an optical sensor 52 of a reflection type disposed at a position adjacent to the first position P1 in the maintenance member 5. The optical sensor 52 has a light emitting part and a light receiving portion (not illustrated), where the light emitting part is disposed in the maintenance member 5. Therefore, light from the light emitting part passes upwardly through the slant part 21 adjacent to the first position P1. The light receiving portion is disposed in the maintenance member 5. If the light receiving portion does not receive reflected light, then the rolled paper 2 has moved to the second position P2 from the first position P1.

In a sixth embodiment of the present invention, after an end state of the rolled paper is detected, the paper 3 is cut and the conveyer continues processing the paper 3 forward of the cut (i.e., the portion of the paper separated from the core). Paper rearward of the cut (i.e., the portion of the paper that remains attached to the core) is no longer conveyed. For example, when an end state is detected when the rolled paper 2 moves from the first position P1 to the second position P2, then a cutting operation is performed.

In a seventh embodiment of the present invention, the conveyer is stopped when an end state is detected and after having stopped conveyance of rolled paper 2, the paper 3 is moved in a reverse direction to remove paper 3 from a conveyance course. According to the seventh embodiment, the rolled paper 2 is stopped when the end is detected so that the rolled paper 2 can be easily taken out from a conveyer, such that it is easy to exchange a used rolled paper with a new rolled paper.

When rolled paper 2 is used that has a paper end that is adhered to core 4, it is usually necessary to remove the rolled paper 2 by cutting paper around the core 4 and removing paper on the conveyance course. In particular, it is necessary for a user to do removal work carefully, since the rolled paper 2 can easily break off, and since the paper can wrinkle. Thus, according to this embodiment, the rolled paper 2 and the core 4 can be removed simultaneously by conveying rolled paper 2 in a reverse course. The paper 3 is removed from a conveyance course by winding the paper 3 on the core 4. Thus, when setting a new rolled paper 2 in a conveyer, it is unnecessary to remove paper 3 from the conveyance course. This is particularly important when the rolled paper 2 has sensitive quality.

In an eighth embodiment of the present invention, once the end state has been reached and the conveyance of the rolled paper 2 has stopped as shown in FIG. 3B, the binding force on the paper 3 from a conveyance course is released so that the paper 3 can be removed by hand. In other words, the conveyance drive releases a torque of a conveyance drive to convey rolled paper 2 so that the paper 3 can be easily removed.

Figure 10:
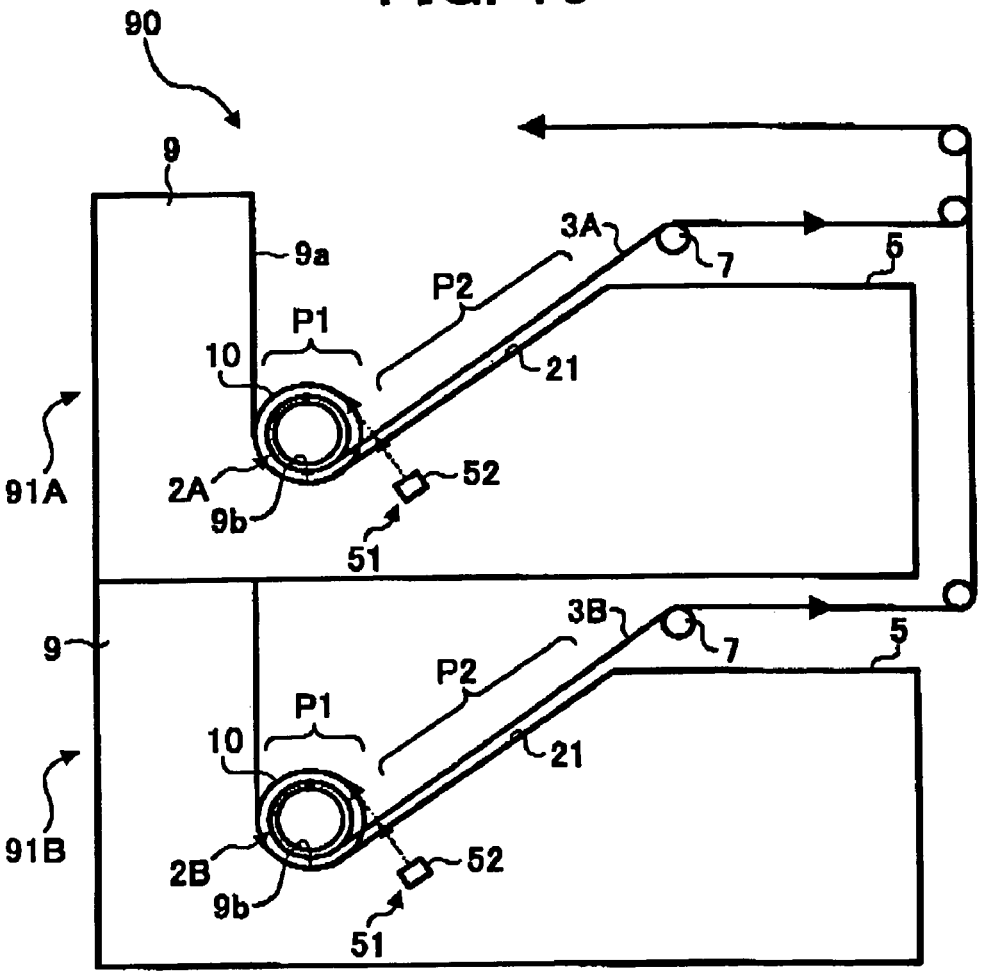
FIG. 10 shows a schematic illustration of a conveyer according to a further embodiment of the present invention.
Figure 11A:
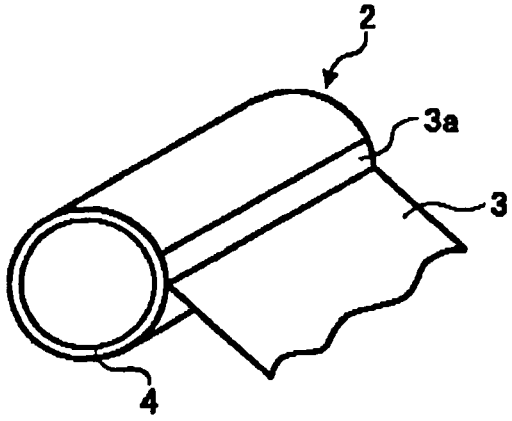
FIG. 11A shows a schematic illustration of end state of a rolled paper.
Figure 11B:
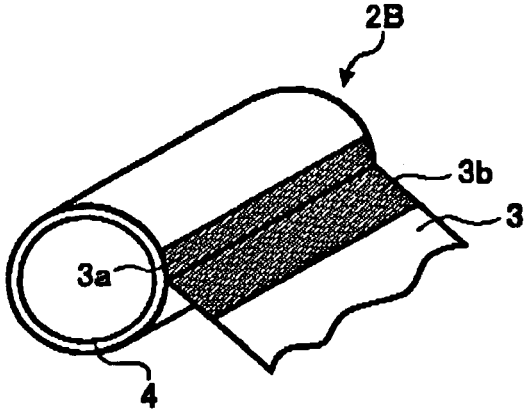
FIG. 11B shows a schematic illustration of another end state of a rolled paper.
Figure 11C:
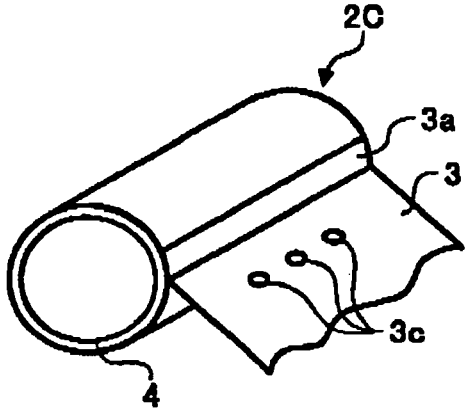
FIG. 11C shows a schematic illustration of another end state of a rolled paper.
Figure 11D:
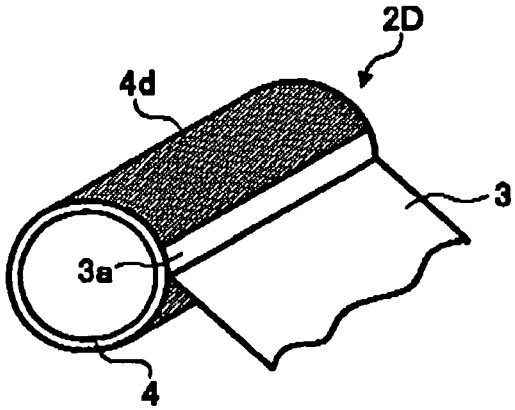
FIG. 11D shows a schematic illustration of another end state of a rolled paper.
Figure 11E:
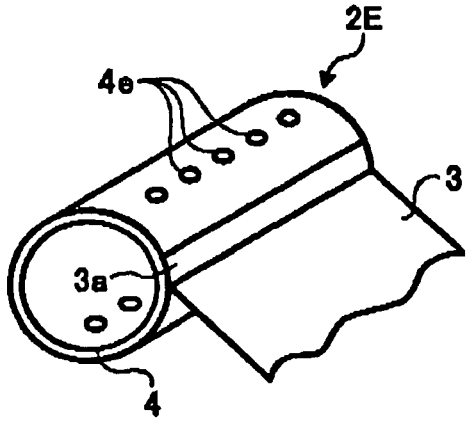
FIG. 11E shows a schematic illustration of another end state of a rolled paper.

FIG. 10 depicts a ninth embodiment of the present invention that includes a conveyer 90 with a conveying device 91A and a conveying device 91B. In the ninth embodiment, when the rolled paper 2A reaches an end state, the paper feed is changed to the rolled paper 2B, which is prepared beforehand, in order to continue conveyance of paper 3B.

The conveyer 90 has a second detection apparatus (not illustrated) that detects the presence of paper 3A on a conveyance course. Therefore, when the rolled paper 2A reaches an end state, the second detection apparatus detects that there is not paper 3A on a conveyance course, and thus conveyance of the rolled paper 2B starts.

In a tenth embodiment of the present invention, when the detection apparatus detects that the rolled paper has moved from the first position P1 to the second position P2, a conveyer of this embodiment has notification means to notify a user of the movement of the rolled paper so that the user can respond quickly.

The various embodiments of the present invention provide many advantages, as described below.

According to the present invention, as the end of the rolled paper is detected by detecting that the rolled paper including a core has moved from the first position to the second position, there is no need to depend on the specific type of rolled paper being used.

According to the present invention, as the slant part is formed upwardly from the first position P1 to a guiding roller, then the rolled paper 2 will slide down to the first position P1 along the face of slant part 21 by itself, thereby making it easier for a user to understand the set place.

According to the present invention, since the movement of the rolled paper is detected automatically, the invention attains high reliability and durability.

According to the present invention, since certain embodiments utilize an optical sensor, the device can be simplified and the printing quality can improve since the paper is not damaged.

According to an embodiment of the present invention, after detecting an end state of the rolled paper, the paper can be cut and the portion of the paper above the cut is conveyed in a conveyance course, so that it is easy to exchange the rolled paper.

According to an embodiment of the present invention, as the rolled paper reaches an end state, it possible to changed the paper feed to another rolled paper prepared beforehand to continue conveyance of the paper, so that a continuous supply of paper is provided.

According to an embodiment of the present invention, since the maintenance member or holding member includes a depressed portion for storing the used rolled paper, a user can attach a new rolled paper without removing the core of old rolled paper. Generally, a width of the core of the rolled paper is long (e.g., about 1 m) and thus the weight of the rolled paper is heavy (e.g., about 10 kg). The apparatus of the present invention can temporarily store used cores of rolled paper within the depressed portion, so that a user can discard the used rolled paper and change rolled paper at a convenient time.

What is claimed is:

1. A rolled paper conveying apparatus for conveying paper of a first rolled paper provided on a core, said apparatus comprising:

a holding device configured to rotatably support the first rolled paper, said holding device having a slanted surface configured to support and guide movement of the first rolled paper from a first position on said holding device to a second position on said holding device;

a conveyance device configured to unroll the first rolled paper and convey the unrolled paper, said conveyance device being configured to move the first roller paper from the first position to the second position; and a first detector configured to detect whether the core of the first rolled paper has moved from said first position to said second position.

2. The rolled paper conveying apparatus of claim 1, further comprising a return member configured to return the core of the first rolled paper from said second position to said first position.

3. The rolled paper conveying apparatus of claim 1, wherein said first detector comprises a photo sensor.

4. The rolled paper conveying apparatus of claim 3, wherein said photo sensor comprises:

a light emitting portion emitting a light to said first position; and a light receiving portion configured to receive light from said light emitting portion that is reflected by the first rolled paper if the first rolled paper is located in the first position.

5. The rolled paper conveying apparatus of claim 4, wherein said light emitting portion is arranged adjacent to said first position so as to emit light to a path along which the first rolled paper moves from said first portion to said second portion.

6. The rolled paper conveying apparatus of claim 1, further comprising a means for controlling a feed of the first rolled paper along a path such that when the first rolled paper is cut based upon a detection result of said first detector, then a first portion of the first rolled paper forward of the cut is further conveyed and a second portion of the first rolled paper rearward of the cut is stopped.

7. The rolled paper conveying apparatus of claim 6, wherein said control means conveys the second portion of the first rolled paper after conveyance of the first portion of the first rolled paper is stopped.

8. The rolled paper conveying apparatus of claim 7, wherein said control means is configured to allow movement of the first rolled paper on the path after stopping conveyance of the first portion of the first rolled paper.

9. The rolled paper conveying apparatus of claim 1, wherein said holding device is configured to rotatably support a second rolled paper, said apparatus further comprising:

a second detector configured to detect paper on a conveyance path; and a switching device configured to switch between conveyance of the first rolled paper and the second rolled paper.

10. The rolled paper conveying apparatus of claim 9, wherein said switching device is configured to convey the second rolled paper when said second detector detects no paper from the first rolled paper on the conveyance path.

11. The rolled paper conveying apparatus of claim 1, further comprising a means for providing a message advising a user when the first rolled paper has moved from said first position to said second position.

12. The rolled paper conveying apparatus of claim 1, wherein said holding device further comprises a depressed portion configured to store the core of the first rolled paper.

* * * * *